US008443532B2

(12) United States Patent
Ong

(10) Patent No.: US 8,443,532 B2
(45) Date of Patent: May 21, 2013

(54) STEAM IRON

(75) Inventor: Chee Keong Ong, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 142 days.

(21) Appl. No.: 13/055,941

(22) PCT Filed: Jul. 24, 2009

(86) PCT No.: PCT/IB2009/053248
§ 371 (c)(1),
(2), (4) Date: Mar. 7, 2011

(87) PCT Pub. No.: WO2010/013185
PCT Pub. Date: Feb. 4, 2010

(65) Prior Publication Data

US 2011/0146115 A1 Jun. 23, 2011

(30) Foreign Application Priority Data

Jul. 31, 2008 (EP) ..... 08161511

(51) Int. Cl.
*D06F 75/18* (2006.01)
*D06F 75/08* (2006.01)

(52) U.S. Cl.
USPC ..... 38/77.8

(58) Field of Classification Search
USPC ..... 38/74–77.83
See application file for complete search history.

(56) References Cited

U.S. PATENT DOCUMENTS

| | | | | |
|---|---|---|---|---|
| 2,664,653 | A | 1/1954 | Voskresenski | |
| 2,708,801 | A | 5/1955 | Voskresenski | |
| 3,872,613 | A * | 3/1975 | Davidson et al. | 38/77.83 |
| 3,986,282 | A * | 10/1976 | Nelson | 38/77.83 |
| 4,656,763 | A * | 4/1987 | Kawasaki et al. | 38/77.83 |
| 6,105,286 | A * | 8/2000 | Ching et al. | 38/77.83 |
| 6,715,884 | B2 | 4/2004 | Barnhurst | |
| 6,763,620 | B1 * | 7/2004 | Voss et al. | 38/77.83 |

FOREIGN PATENT DOCUMENTS

| | | |
|---|---|---|
| GB | 484974 A | 5/1938 |
| GB | 2327950 A | 2/1999 |
| WO | 9945190 | 9/1999 |

* cited by examiner

*Primary Examiner* — Ismael Izaguirre

(57) ABSTRACT

Steam irons with a steam valve that is controlled by an intuitively operated, usually pivotable handle may not provide consistent steam ironing behavior due to the fact that the force exerted on the handle by the user may change over time. To overcome or mitigate the problem, the present invention provides a steam iron (1), comprising a by-pass (9) around the handle-operated valve (7). The by-pass allows a relatively small but continuous water stream to be transported from a water reservoir (6) to steam outlet openings (12) in the soleplate (11) of the iron. Consequently, subject to an ample supply of water, the steam iron provides a minimum of steam ironing comfort throughout a steam ironing session.

14 Claims, 2 Drawing Sheets

STEAM IRON

FIELD OF THE INVENTION

The invention relates to steam irons, and more in particular to the control of steaming functions of such irons.

BACKGROUND

A domestic steam iron has the capability to generate steam and to subsequently release this steam through outlet openings provided in the soleplate of the iron. The steam, which is applied directly to a garment being ironed, helps to diminish the ironing effort and to improve the ironing result.

To store the water that is to be released as steam, a steam iron is commonly fitted with a water reservoir. From there, a water channel guides the water either to a special steam chamber or directly to the soleplate of the iron, where it is heated and converted into steam. Thereafter, it may be released through the outlet openings in the soleplate. Normally, the generation and release of steam is desired only when the iron is in contact with a garment that is being ironed. Several arrangements to ensure such safe and energy-efficient steam iron behaviour have been disclosed in the art. In some of them, an iron is provided with a handle that can be used to control a valve that is disposed in the water channel leading from the water reservoir to the outlet openings in the soleplate of the iron. The handle is preferably operated intuitively, such that it is automatically forced into a position that corresponds to an open position of the valve when a user grips the iron in a manner that indicates an actual ironing activity. Intuitively operated handles commonly rely on the downward force that is exerted by a user's hand on the handle as the user steers the iron across the garment. When a user lifts the iron off of the garment, or when the iron is parked on an iron rest, no downward force is present, indicating that no actual ironing activity takes place. In the absence of a downward force, a biasing mechanism will push the handle into its stationary position, thereby ensuring closure of the valve such that no steam is released.

Research has shown that the forces exerted on a handle by ironing users range from less than 100 gf (0.98 N) to about 4 kgf (39 N). In addition, individual users do not display consistent force-exertion behaviour during a single ironing session either. Users of an iron with an intuitively operated handle may therefore not, or not at all times, automatically apply sufficient force to the handle to open the valve in order to effect the release of steam. From a user point of view, this corresponds to inconsistent iron behaviour: at the one moment the iron may release steam while at the other it doesn't, without a conscious choice being made by the user in between. Furthermore, any temporary or structural disruption of the steam supply due to a variable or consistently insufficient force may increase the ironing effort and worsen the ironing result.

SUMMARY

It is an object of the present invention to provide for a steam iron that overcomes or mitigates one or more of the above-described effects of applying a variable and/or small force to the handle that operates the valve.

According to an aspect of the present invention, a steam iron is provided that includes a housing; a water reservoir; a soleplate that is connected to the housing, and in which at least one outlet opening is provided for the release of steam; and a water channel leading from the water reservoir to the at least one outlet opening in the soleplate. The steam iron further includes a handle, the handle being connected to the housing such that the handle is moveable between a first position and a second position, whereby a biasing mechanism is provided to bias the handle into the first position. The steam iron also includes a valve, disposed in the water channel and operably connected to the handle, such that the valve is in a closed position when the handle is in the first position, and such that the valve is in an open position when the handle is in the second position. The steam iron is further provided with a by-pass around the handle-operated valve for delivering water from the water reservoir to an outlet opening in the soleplate.

According to another aspect of the present invention, a method for steam ironing using a steam iron is provided. The method includes providing a fluid including water ($H_2O$), and transporting a first fluid stream to a selectively operable valve that is intuitively operable by a handle. The method also includes transporting a second stream of fluid, by-passing the valve, to steam outlet openings in a soleplate of the iron. The method further includes transporting the first fluid stream that has passed the valve to steam outlet openings in the soleplate of the iron.

A steam iron according to the present invention aims to provide a minimum steam rate, independent of the force that the user applies to the handle of the iron. To this end, it features a by-pass around the handle-operated valve: a water path, leading from the water reservoir to one or more outlet openings in the soleplate, wherein the valve is not included. The result is that even when no or an insufficient force is exerted on the handle, in which case the valve remains in its closed position, water is allowed to flow from the water reservoir to outlet openings in the soleplate. A minimum flow of steam may thus be released from the soleplate even when the valve is in its closed position, ensuring a minimum of steam ironing comfort and steam ironing results. A steam iron according the present invention may be used to practise the method according to the present invention.

Thus, in summary: steam irons with a steam valve that is controlled by an intuitively operated, usually pivotable handle may not provide consistent steam ironing behaviour due to the fact that the force exerted on the handle by the user may change over time. To overcome or mitigate the problem, the present invention provides a steam iron, comprising a by-pass around the handle-operated valve. The by-pass allows a relatively small but continuous water stream to be transported from a water reservoir to steam outlet openings in the soleplate of the iron. Consequently, subject to an ample supply of water, the steam iron provides a minimum of steam ironing comfort throughout a steam ironing session.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
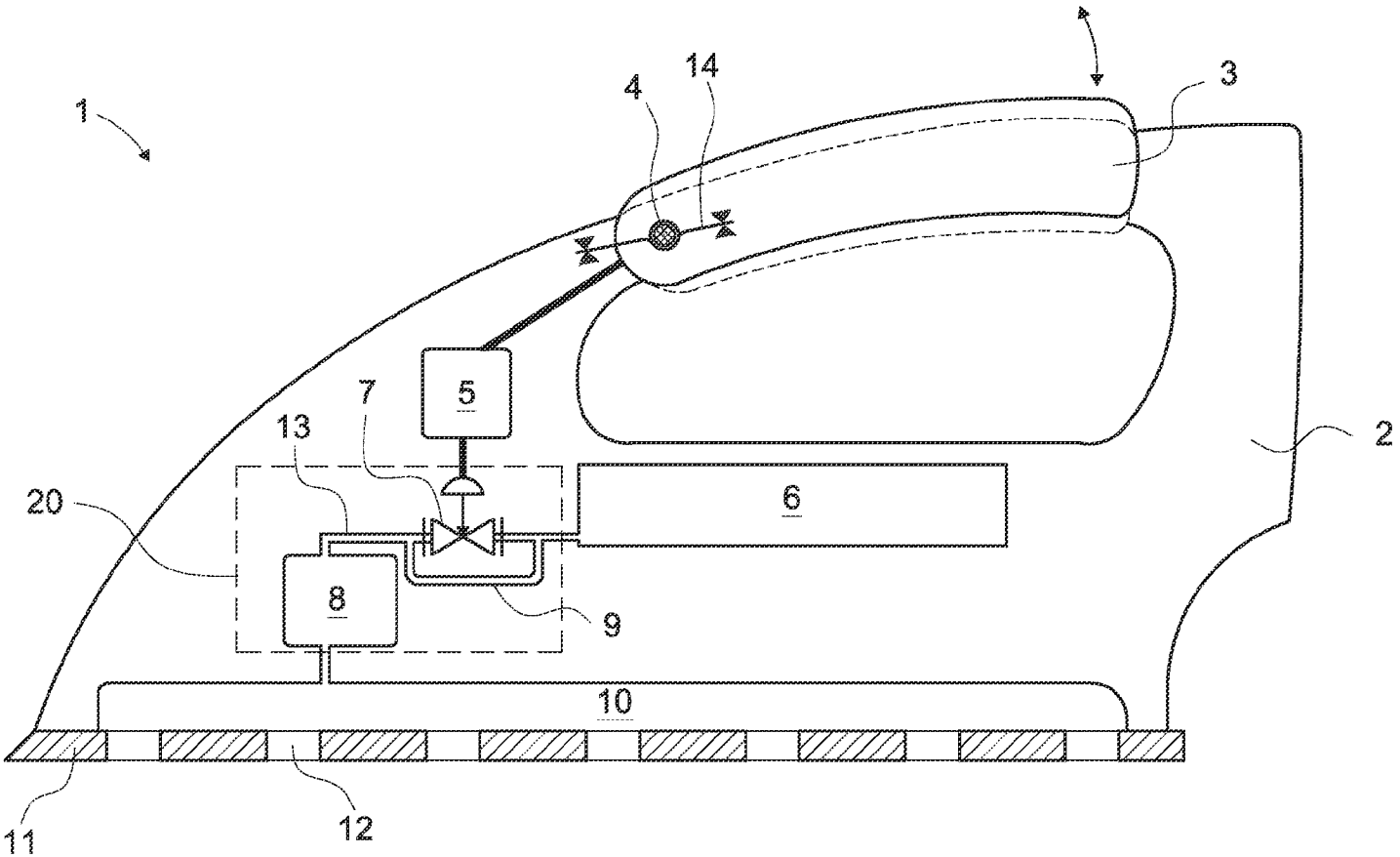
FIG. 1 is a schematic illustration of an embodiment of a steam iron according to the present invention.

FIG. 1 schematically shows an embodiment of a steam iron 1 according to the present invention. It will be appreciated that several components of the iron which are well known and have no particular relevance to the present invention are omitted for reasons of clarity.

Steam iron 1 comprises a housing 2 that is fitted with an intuitively operated handle 3. Handle 3 is pivotable between a first, elevated position and a second, lower position around a hinge 4 that connects the handle 3 to the housing 2. In FIG. 1, handle 3 is hinged near its front end, though in other embodiments it may be hinged at other points, such as its middle or its back end. Due to the action of a biasing mechanism 14, handle 3 resides in its first position when no external, downward force is applied thereto. A biasing mechanism may, for example, be integrated in hinge 4 in the form of a spring hinge. Handle 3 is operably connected to a valve 7 via a link mechanism 5, such that valve 7 is in a closed position when handle 3 is in its first position and in an open position when the handle 3 is in its second position. Valve 7 is disposed in a water channel 13 that leads from a refillable water reservoir 6 to outlet openings 12 in the heated soleplate 11. When valve 7 is in an open position, water is allowed to flow from reservoir 6, through valve 7 and through an optional metering/dripstop-assembly 8—to be discussed hereafter—to a heated steam chamber 10. In steam chamber 10, the water is converted from its liquid form into steam, after which it is released through outlet openings 12 in soleplate 11.

Without the presence of a by-pass 9, the only way for water from the water reservoir 6 to reach the outlet openings 12 would be through valve 7. Naturally, a closed valve 7 would correspond to no release of steam, whereas an open valve 7 would allow the supply of water to steam chamber 10 for steam generation and the subsequent release thereof. As the natural force applied to handle 3 during ironing may differ from user to user, and may be variable over time for a single user, the position of handle 3, and thus the position of the valve 7 during ironing is not fully predictable. Accordingly, the steaming behaviour of iron 1 would be unpredictable as well. To mitigate this erratic conduct, and to provide the user with a minimum of steam ironing comfort at all times, by-pass 9 is provided. By-pass 9 ensures a minimum of steam release during ironing, which steam release is boosted when handle 3 is pressed into its second position.

A by-pass may take many shapes. It may, for example, be formed as a water conducting conduit that branches off from the water channel upstream of the valve and that returns thereto downstream of the valve, so as to provide a path parallel to a water channel section comprising the valve (as shown in FIG. 1). Likewise, a by-pass may be implemented as a systematically leaking valve, or as a hole or passage next to the valve in a channel wall, which wall is provided in the water channel as a flow blockage (see FIG. 2B). In these cases, the by-pass may be said to have been provided in the water channel, in the sense that the flow of water through the by-pass may be subject to the same controls as the flow of water through the valve, such as for example a drip-stop control or a metering device (see infra the discussion of FIG. 2). Alternatively, a by-pass may constitute a second, independent water channel that leads from the water reservoir (or another, second water reservoir) to a steam chamber, or even directly to one or more outlet openings in the soleplate. It is noted that in the latter embodiment, the outlet openings that are configured to release the by-pass steam do not necessarily have to be the same as those in which the (first) water channel discharges itself.—In general, any path that delivers water, steam or liquid, to the outlet openings in the soleplate of the iron, other than through the handle-operated valve, may be considered a by-pass.

The minimum steam rate that the by-pass should warrant need not be very high. Typically, a steam rate of around 12-24 g/min will suffice to achieve an agreeable steam ironing effect, while higher minimum steam rates may result in unnecessarily high energy losses due to steam release when no ironing takes place. The precise minimum steam rate provided for by the by-pass may be made user-adjustable. To this end, the by-pass may for example be fitted with a by-pass valve that allows the effective cross-sectional area of the by-pass to be controlled, whereby the by-pass valve itself may be operated by a dial provided on the outside of the housing of the iron. As a base steam rate of 12-24 g/min is relatively small compared to the overall steam rate that may be applied during ironing, which is typically around 25-95 g/min, the by-pass and the by-passed section of the water channel may be dimensioned such that—in use, and given the same flow-driving pressure—a flow rate of water through the by-pass is smaller than a flow rate of water through the section of the water channel with the valve in its (fully) open position.

Although FIG. 1 depicts a steam iron with an integrated water reservoir 6, i.e. a water reservoir integrated into the housing 2 that is purposefully moveable by the user during ironing, it is noted that in another embodiment of the steam iron the water reservoir may be arranged external to said housing 2 in a stationary body. This arrangement is common in so called steam iron systems, which, as a rule, feature a relatively large water reservoir and a pressurized steam chamber upstream of the handle-operated valve. In contrast to the embodiment of FIG. 1, in which the valve 7 controls a flow of liquid water, the valve in these steam iron systems may control a flow of steam. This is a result of the fact that heating of the water in the former embodiment tends to be taken care of downstream of the valve 7, near the soleplate 11 of the iron 1, while in the latter embodiment heating is provided for in the aforementioned external, pressurized steam chamber.

Though the above-described handle-operated valve 7 and the by-pass 9 around it improve the consistency of the iron's behaviour, control over the steam rate of iron 1 may be further improved. An iron 1 fitted with said features will normally produce a relatively small, constant base steam rate during an entire ironing session (i.e. during the time the iron 1 is energized), and discharge additional steam in proportion to the displacement of handle 3 from its first position. 'In proportion' because of the mechanical nature of the link mechanism 5 by means of which the handle 3 is connected to the valve 7. As set forth above, valve 7 may be operated between a first and a second position. These two extreme valve positions, and any position therebetween, may correspond to different flow rates through the water channel 13, and thus to different steam rates of iron 1. An intermediate valve position corresponds to a handle position between the first and second handle position. A specific intermediate handle position, however, is not easily selectable by a user during ironing, which causes the control over the valve 7 by means of the handle 3 to be somewhat inaccurate. This problem may be solved by enhancing the binary character of the handle-operated valve 7. To this end, handle 3 may be operably connected to valve 7 by means of a mechanical linkage amplification mechanism 5 that provides a mechanical advantage. A mechanical linkage amplification mechanism 5 may be provided in the form of a lever system, a rack and pinion system, a gear system or any other type of amplification system known in the art. The mechanical advantage can be in the form of a larger output displacement or a higher output force. Through the use of an amplification mechanism 5, small user inputs—e.g. a small handle displacement or a small force applied to the handle—can be amplified to narrow the input displacement/force interval that corresponds to an intermediate position of the valve. The input force interval that corresponds to an intermediate position of the valve valve may for example be narrowed to 100-500 gf (0.98-4.9 N), or even smaller. Advantageously, the amplification mechanism may also take care of any play due to the tolerance stack-up in the design of the handle-operated valve.

The handle-operated valve including a mechanical linkage amplification mechanism 5 thus provides a substantially on/off-switch functionality that—purposefully—does not allow the user to select a specific, desired steam rate. A user, however, may desire to control the steam rate of the iron 1 in such a way that he or she can adjust the steam rate between zero (dry ironing) and a certain user-defined maximum. To this end, the iron 1 may be fitted with a conventional metering device, which will be described in some detail with reference to FIG. 2.

FIG. 2 schematically illustrates how a handle-operated valve 7, a by-pass, and a conventional metering system may be coherently arranged in a water channel 13. In addition, a drip-stop 23 is shown as well. The assemblies shown in FIG. 2 may be thought of as implementations of the components located in the area demarcated by a dashed line 20 in FIG. 1. To define the flow direction in FIG. 2, an upstream point of the water channel 13 is marked 21, and a downstream point in water channel 13 is marked with 29.

Figure 2A:
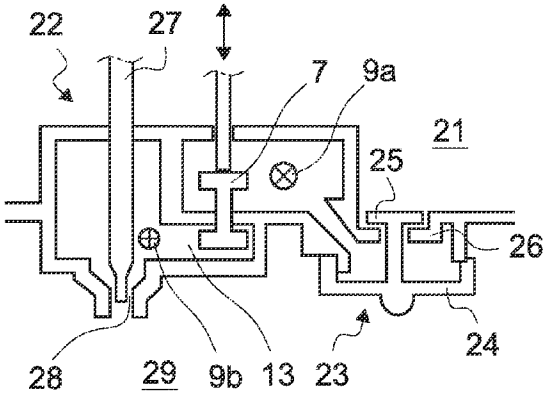
FIG. 2 schematically shows a number of possible arrangements of a handle-operated valve plus by-pass, a drip-stop and a metering device in the water channel.

Referring to FIG. 2A now. Going downstream from the point marked 21, the first component disposed in the water channel 13 is drip-stop 23. A drip-stop may be provided in the water channel to stop the flow of water from the water reservoir (not shown in FIG. 2) to the soleplate of the iron (not shown in FIG. 2) in case the temperature of the soleplate is lower than a preset value. A simple yet effective drip-stop 23 may be made from a bimetallic strip or disc 24 that is exposed to the heated soleplate, and that converts a sufficiently high temperature of the soleplate into a mechanical displacement of the valve head 25, so as to push it from the valve seat 26 in order to unblock water channel 13. Downstream of drip-stop 23 the handle-operated valve 7 is disposed. The by-pass provided around valve 7 is denoted with two reference signs: ⊗ and ⊕. The first sign ⊗, , labelled 9*a*, marks an upstream point of the by-pass, e.g. a point where a by-pass conduit branches off from water channel 13, whereas the second sign ⊕, labelled 9*b*, marks a downstream point of the by-pass, e.g. a point where the by-pass conduit returns to water channel 13. Even more downstream in water channel 13, the metering device 22 is located. It comprises a suitably shaped pin 27 that is moveable relative to an aperture 28, such that the higher it is raised the more water passes by the tapered end and through the aperture 28. The vertical position of pin 27 may be controlled by means of a user-operable control, such as a knob, dial or slider, which is accessibly disposed on the outside of the housing 2 of the iron 1.

Figure 2B:
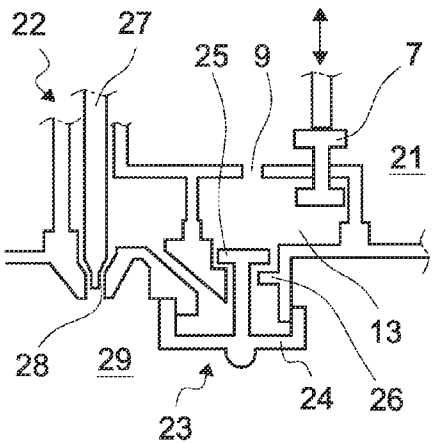
Figure 2C:
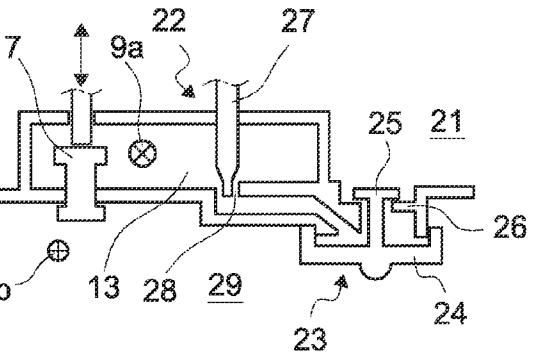
Figure 2D:
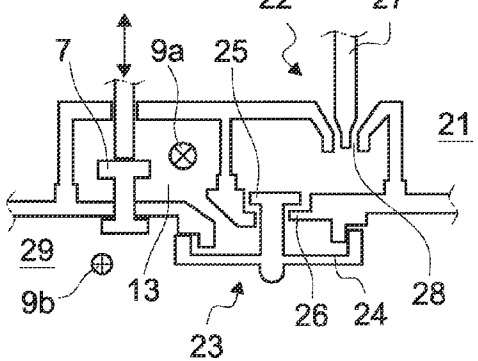

In principle, valve 7 plus the bypass, drip-stop 23 and metering device 22 may be disposed in water channel 13 in arbitrary order, giving rise to six alternative arrangements. Two of them however, namely the ones in which drip-stop 23 is the most downstream element, are somewhat less advantageous than the other four. This is because water may accumulate in the section of water channel 13 between drip-stop 23 on the one side, and metering device 22 or valve 7 plus by-pass 9 on the other. Such accumulation will occur in particular when a user opens valve 7 or sets metering device 22 to an open position before soleplate 11 of the iron is well-heated. Once drip-stop 23 opens to unblock the water channel 13, a relatively large amount of accumulated water may flow uncontrolled towards outlet openings 12 in soleplate 11, which may cause a sudden boost of steam. FIG. 2B-D therefore schematically show only three favourable alternative arrangements relative to the arrangement shown in FIG. 2A. The reference numerals in FIG. 2B-D refer to the same or similar components as those depicted in FIG. 2A. In FIG. 2B, the by-pass 9 is formed as a passage in a channel wall, next to the valve 7. It may be worth noting that, seen in a downstream direction, FIG. 2B depicts the components in the order: valve 7 plus by-pass 9, drip-stop 23 and metering device 22, FIG. 2C depicts them in the order: drip-stop 23, metering-device 22, valve 7 plus by-pass, and FIG. 2D depicts them in the order: metering device 22, drip-stop 23, valve 7 plus by-pass.

Together, the components depicted in FIG. 2 constitute a relatively simple and efficient system for controlling the flow rate of water through channel 13, and thus the steam rate of the iron in which it is implemented. In short, a system according to any of the FIG. 2A-D allows a user to select a dry-ironing or steam-ironing mode of the iron, and, in case the later mode is chosen, to determine the maximum steam rate desired. Subject to the provisions that the steam-ironing mode is selected and that the soleplate 11 is sufficiently heated, such that drip-stop 23 does not block water channel 13, water is allowed to flow from water reservoir 6 to outlet openings provided in the soleplate 11 of iron 1. A relatively small flow of water is allowed to flow through the by-pass 9 continuously, to provide for a minimum of steam ironing comfort independent of the position of valve 7. When the valve 7 is moved into its second, open position by means of the intuitive handle 3, indicating an actual ironing activity, the flow of water through channel 13 is maximised.

It is noted that FIG. 2 illustrates an advantage of providing a by-pass in water channel 13, as opposed to providing a by-pass separate therefrom. A by-pass provided in water channel 13 is automatically subjected to any flow restriction that the drip-stop and/or the metering system 22 may impose on the flow of water through the channel, whereas in a second, separate channel these restrictions may have to be imposed separately as well.

Although illustrative embodiments of the present invention have been described with reference to the accompanying drawings, it is to be understood that the invention is not limited to these embodiments. Various changes or modifications may be effected by one skilled in the art without departing from the scope or the spirit of the invention as defined in the claims. Accordingly, reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that the particular features, structures, or characteristics may be combined in any suitable manner in one or more embodiments.

The invention claimed is:

1. A steam iron, comprising:

a housing;

a water reservoir;

a soleplate that is connected to the housing, and in which at least one outlet opening is provided for the release of steam;

a water channel leading from the water reservoir to the at least one outlet opening in the soleplate;

a handle, the handle being connected to the housing such that the handle is moveable between a first position and a second position, whereby a biasing mechanism is provided to bias the handle into the first position;

a valve, disposed in the water channel and operably connected to the handle, such that the valve is in a closed position when the handle is in the first position, and such that the valve is in an open position when the handle is in the second position;

wherein the steam iron is further provided with an unregulated by-pass extending partially around the handle-operated valve for continuously delivering water from the water reservoir to an outlet opening in the soleplate independent of the open or closed position of the valve.

2. Steam iron according to claim 1, wherein the by-pass is provided in the water channel.

3. A steam iron according to claim 1, wherein the by-pass and the by-passed section of the water channel are dimensioned such that—in use, and given the same flow-driving pressure—a flow rate of water through the by-pass is smaller than a flow rate of water through the section of the water channel with the valve in its open position.

4. A steam iron according to claim 1, wherein the by-pass is dimensioned such that—in use—it allows for a mass flow rate of approximately 12-24 g/min (grams per minute).

5. A steam iron according to claim 1, wherein the by-pass is formed as a water conducting conduit that branches off from the water channel upstream of the valve and that returns thereto downstream of the valve, so as to provide a path parallel to a water channel section comprising the valve.

6. Steam iron according to claim 1, wherein the water reservoir is integrated into the housing.

7. A steam iron according to claim 1, wherein the handle and the biasing mechanism are constructed such that in a normal, operable orientation of the iron the handle is moveable from its first position into its second position through the application of a downward force on the handle.

8. A steam iron according to claim 1, wherein the handle is operably connected to the valve by means of a linkage amplification mechanism, so as to provide a substantially on/off functionality.

9. A steam iron according to claim 1, wherein the force required to move or hold the handle into a position that corresponds to the second position of the valve is 4.9N (500 gf) or less.

10. A steam iron according to claim 1, wherein, upstream or downstream of the bypass and the bypassed section of the water channel, a drip-stop is provided.

11. A steam iron according to claim 1, wherein, upstream or downstream of the by-pass and the by-passed section of the water channel, a metering device is provided.

12. A method for steam ironing using a steam iron, the method comprising:

providing a fluid including water ($H_2O$);

transporting a first fluid stream to a selectively operable valve that is intuitively operable by a handle;

transporting a second stream of fluid via a by-pass thereby by-passing the valve, to steam outlet openings in a soleplate of the iron; and transporting the first fluid stream that has passed the valve to steam outlet openings in the soleplate of the iron wherein the by-pass is an unregulated by-pass extending partially around the selectively operable valve.

13. A method according to claim 12, wherein the first and/or second fluid stream is substantially a stream of liquid water.

14. A method according to claim 12, wherein the first and/or second fluid stream is substantially a stream of steam.

* * * * *